US005954567A

United States Patent [19]

Nishio et al.

[11] Patent Number: 5,954,567

[45] Date of Patent: Sep. 21, 1999

[54] PROCESS FOR MACHINING AN EDGE PORTION OF A CERAMIC ARTICLE PREFORM WITHOUT CHIPPING

[75] Inventors: Akifumi Nishio, Nagoya, Japan; Carine Anne-Marie Claudine Dewitte, Ottignies; Jeffrey Philip John Pattimore, Baudour, both of Belgium

[73] Assignees: NGK Insulators, Ltd., Japan; NGK Ceramic Europe S.A., Belgium

[21] Appl. No.: 08/942,978

[22] Filed: Oct. 2, 1997

[30] Foreign Application Priority Data

Oct. 2, 1996 [JP] Japan ..... 8-279887
Jan. 31, 1997 [JP] Japan ..... 9-031420

[51] Int. Cl.[6] ..... B24B 1/00

[52] U.S. Cl. ..... 451/44; 451/41; 451/49

[58] Field of Search ..... 451/49, 57, 58, 451/28, 44, 41

[56] References Cited

U.S. PATENT DOCUMENTS

| | | | |
|---|---|---|---|
| 3,520,091 | 7/1970 | Raphael | 51/284 |
| 4,344,260 | 8/1982 | Ogiwara . | |
| 4,503,613 | 3/1985 | Yax | 51/284 E |
| 5,000,630 | 3/1991 | Riley et al. | 408/228 |
| 5,094,037 | 3/1992 | Hakomori et al. | 51/165.77 |
| 5,410,843 | 5/1995 | Gottschald | 450/43 |
| 5,711,700 | 1/1998 | Raffaelli | 451/43 |

FOREIGN PATENT DOCUMENTS 0 518 641 A1 12/1992 European Pat. Off. .

OTHER PUBLICATIONS

Patent Abstracts of Japan; vol. 012, No. 343 (M–741), Sep. 14, 1988 & JP 63 102860 (Sumitomo Electric Ind Ltd), May 7, 1988; *abstract; figures*.

Patent Abstracts of Japan; vol. 004, No. 165 (E–034), Nov. 15, 1980 & JP 55 113332 A (Hitachi Ltd), Sep. 1, 1980; *abstract; figures*.

*Primary Examiner*—David A. Scherbel
*Assistant Examiner*—Dung Van Nguyen
*Attorney, Agent, or Firm*—Parkhurst & Wendel, L.L.P.

[57] ABSTRACT

A process for machining edge portions of a ceramic article preform without chipping includes grinding in such consecutive machining steps and machining directions that a chipped portion which results in a machined part of the edge portion in a machining step, is removed by any succeeding. Further, a lastly remaining part of the edge portions of the ceramic article preform is machined in a final step without chipping, thereby enabling the edge portion of the ceramic article preform to be ground without chipping.

14 Claims, 9 Drawing Sheets

PROCESS FOR MACHINING AN EDGE PORTION OF A CERAMIC ARTICLE PREFORM WITHOUT CHIPPING

BACKGROUND OF THE INVENTION

1. Field of the Invention

The present invention relates to an improvement on a process for machining an edge portion of a ceramic article preform, particularly, an edge portion of a ceramic article preform having a rotationary symmetrical edge.

2. Related Art Statement

When a workpiece such as a preform of a ceramic article is to be ground, a machining order and machining directions are subjected to arbitrary discretion of a worker, or such machining order and machining directions are selected from the standpoint of shortening the machining time. When the ceramic article preform is to be machined by a machining tool such as a grinding stone in a traverse machining, no chipping occurs at a side of a machining face of the ceramic article preform which the machining tool enters because mainly compression stress applies, whereas because tensile stress applies to a side of the machining face of the preform through which the grinding tool leaves, chipping inevitably occurs there. Since the ceramic article is conventionally finished after being ground, it is an actually common practice to machine the preform in such a machining order and machining directions as causing chipping without taking any countermeasure to preventing the chipping. However, if the ceramic article is chipped, it is considered that the ceramic article, particularly a structural article such as an engine valve, begins to be broken from a chipped portion.

The above chipping phenomenon is explained with reference to the conventional process for grinding a preform of a ceramic valve by way of example. FIG. 1 is a schematic view for illustrating an apparatus which is to continuously machining ceramic valve preforms each having a rotation symmetrical shape. The ceramic valve preforms are machined according to the following four steps (1) to (4).

(1) The ceramic valve preform is conveyed to a station 1 from a feed side by means of a chuck C1-1, and chucked by a chuck C1-2. Then, a head portion and a rear end portion of a shaft of the valve preform shown by circles in FIG. 1 are ground by a grinding tool not shown.

(2) The ground ceramic valve preform is chucked by the chuck C1-1, and placed on a reversing station where the preform is reversed at 180.

(3) Then, the reversed ceramic valve is arranged between chuck heads C2-2*a* and C2-2*b* at a station 2 by means of a chuck C2-1, and is finish ground by a finish grinding tool not shown.

(4) The finish ground ceramic valve is conveyed to a discharge side.

The chipping phenomenon discussed in the present application occurs in the grinding step in the station 1.

FIG. 2 shows portions of the ceramic valve preform W chucked by the chuck C1-2 in the station 1, the portions being to be machined by a grinding stone T as a grinding tool in the state that the valve preform is being rotated around its axis. FIGS. 3 and 4 show the order and directions for machining a head portion and a rear end portion of a shaft of the valve preform according to a conventional machining process, respectively. In this conventional machining process, in order to decrease a grinding load, the movement of the grinding stone is controlled under the rotation of the valve preform W. As to the valve head portion, the grinding stone is moved from right to left as shown by a reference number "1" in FIG. 3 to grind a peripheral face of the head portion. Then, the grinding stone is moved obliquely upwardly from left to right as shown by a reference numeral "2". Thereafter, an end face of the valve head portion is ground by moving the grinding stone not through the entire end face but up to a central portion of the end face as shown by a reference numeral "3", different from the machining in the above "1" and "2". Finally, a corner portion of the head portion formed by the machining in the above "1" and "3" is chamfered by moving the grinding tool obliquely downwardly from left to right as shown in a reference numeral "4". Similarly, as to the rear end portion of the shaft of the valve preform, in order to decrease a grinding load, the movement of the grinding stone is controlled under the rotation of the valve preform W in FIG. 4. As to the rear end portion of the valve shaft, the grinding stone is moved from left to right as shown by a reference numeral "1" to grind a peripheral face of the shaft. Thereafter, as to an end face of the shaft, this end face is ground by moving the grinding stone not through the entire end face but up to a central portion of the end face as shown by a reference numeral "2", different from the machining in the above "1". Finally, a corner portion of the head portion formed by the machining in the above "1" and "2" is chamfered by moving the grinding tool obliquely downwardly from right to left as shown by a reference numeral "3". According to the above machining process, when the grinding stone grinds the ceramic valve preform through the entire grinding face, chipping may occur (See A and B in FIG. 3 and C in FIG. 4). Each of the valve head portion and the shaft portion of the ground ceramic valve preform is trimmed into a desired shape in the station 2 by the finish grinding (See shapes designated by dotted lines in FIGS. 3 and 4). However, there is possibility that a chipping trace remains even after the finish grinding. In order to completely remove the chipping trace, a finish grinding amount needs to be increased. FIGS. 5 and 6 are enlarged photographs for showing chipping occurred at an edge portion of the shaft and the head portion of the valve preform ground in the first station according to the conventional machining process, respectively (See B in FIG. 3 and C in FIG. 4). As is seen from these figures, the chipped portions remain in the head portion and the edge portion of the shaft of the valve.

SUMMARY OF THE INVENTION

The present inventors decreased the machining speed or decreased the grain size of the grinding stone to prevent or reduce the occurrence of the above chipping phenomenon, but the occurrence of the chipping could not be prevented or reduced. On the other hand, it was clarified that although the chipping phenomenon may be slightly mitigated by decreasing the machining speed in some cases, this largely increases the machining time and makes the process unsuitable for the mass-production.

Further, it was also clarified that in order to incorporate the production of ceramic articles into a mass-production line without suffering the chipping phenomenon, a succeeding chipping-removing step needed to be effected after an initial grinding step, or a post-grinding step needed to be effected in such an excess extent as presumably meeting a chipped level. In those cases, the number of the producing steps increases or the production cost rises due to a low yield.

The term "edge portion" is a concept which includes a border line at which two different faces intersect as well as a vicinity thereof (totally referred to a boundary line portion). For example, a boundary line portion between an end face and a cylindrical peripheral face, a border line portion between an end face and a truncated conical face, a border line portion where different truncated conical faces intersect, a border line portion where a cylindrical face and a curved face intersect, etc. may be recited. The end face may be included in the edge portion.

Under the circumstances, it is an object of the present invention to solve the above-mentioned problems, and to provide a process for machining an edge portion of a ceramic article preform without chipping at the surface thereof.

The process for machining edge portions of the ceramic article preform without chipping according to the present invention is characterized in that consecutive machining steps and machining directions are selected such that a chipped portion occurring in a machined part of said edge portion in a certain machining step is removed by any succeeding step, and a lastly remaining part of the edge portions of ceramic article preform is machined in a final step without chipping, thereby enabling the edge portion of the ceramic article preform to be ground without chipping.

As preferred embodiments of the process for machining the edge portion of ceramic article without chipping according to the present invention, the following are recited.

(1) Said edge portion of the ceramic article is included in any one of an edge face, a peripheral face continuing to the edge face, an inclined face continuing to the peripheral face, and a concaved face continuing to the inclined face, and said consecutive machining steps and said machining directions are selected such that a side of a machined part of the ceramic article through which a grinding tool left in a certain machining step is set at a side of a part of the ceramic article through which the grinding tool enters in any succeeding step.

(2) The process for machining the edge portion of ceramic article preform without chipping according to the present invention is particularly suitable for grinding an end portion of a head portion and a rear end portion of a shaft of a ceramic valve preform, end portions of ceramic tube, edge portions of a ceramic support pin jig, edge portions of an all-ceramic turborotor, etc., each having a rotation symmetrical shape.

(3) Said machining of said lastly remaining part of the edge portions of the ceramic article preform in said final step without chipping is to machine an end face of the ceramic valve preform, said end face exteding in a direction substantially perpendicular to the axis in said rotation or being convexed in an axially outward direction.

These and other objects, features and advantages of the invention will be appreciated upon reading of the following description of the invention, with the understanding that some modifications, variations and changes of the same could be easily made by the skilled person in the art.

BRIEF DESCRIPTION OF THE DRAWINGS

For a better understanding of the invention, reference is made to the attached drawings, wherein.

DETAILED DESCRIPTION OF THE INVENTION

In the following, a specific embodiment of the present invention will be explained.

Figure 1:
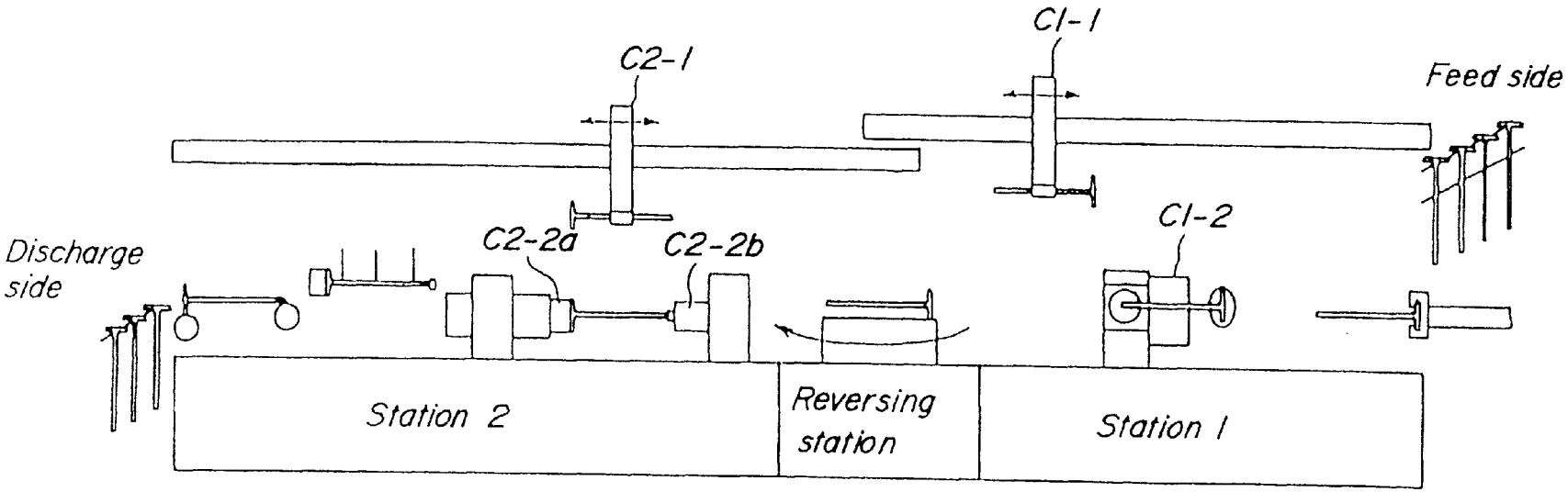
FIG. 1 is a schematic view of the apparatus for continuously machining the ceramic valve preforms each having a rotation symmetrical shape.
Figure 2:
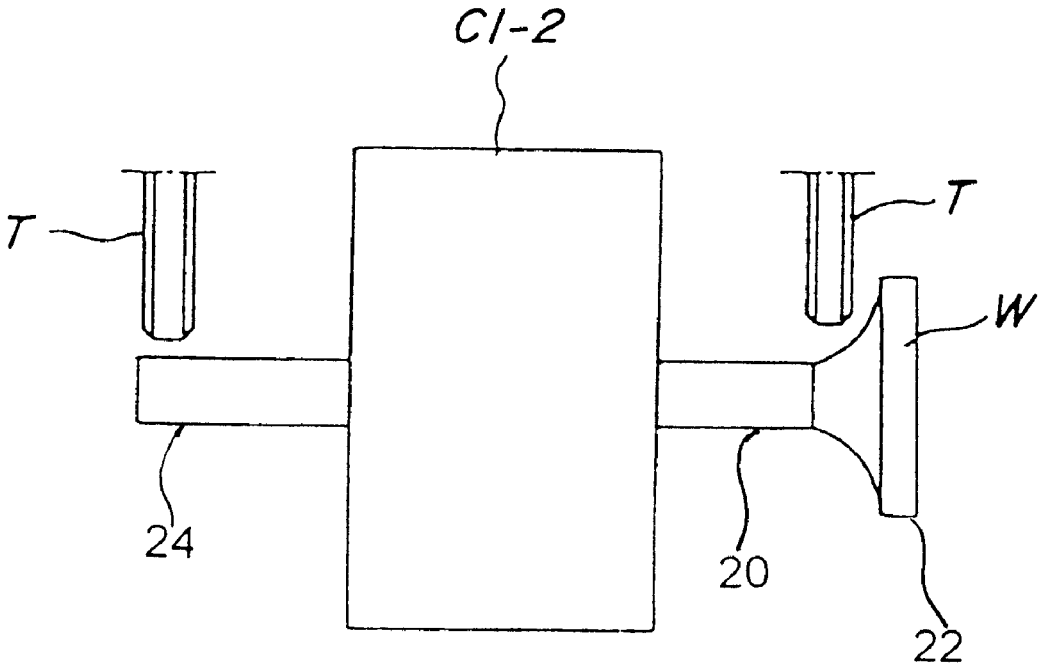
FIG. 2 shows portions of the ceramic valve preform W chucked by the chuck 1-2 in the station 1, said portions being to be machined by a grinding stone T as a grinding tool in the state that the valve preform is being rotated around its axis.
Figure 3:
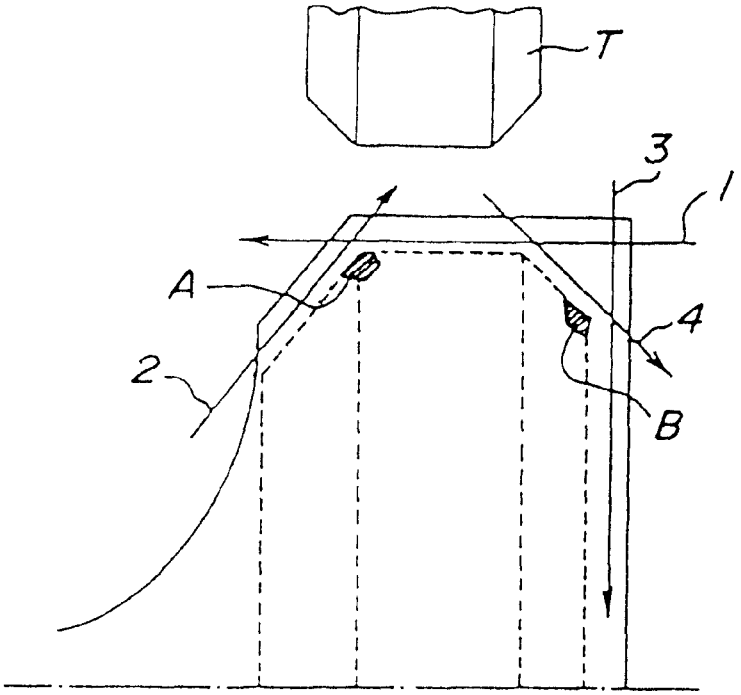
FIG 3 PRIOR ART
FIG. 3 shows the order and directions for machining a head portion of the valve preform according to a conventional machining process.
Figure 4:
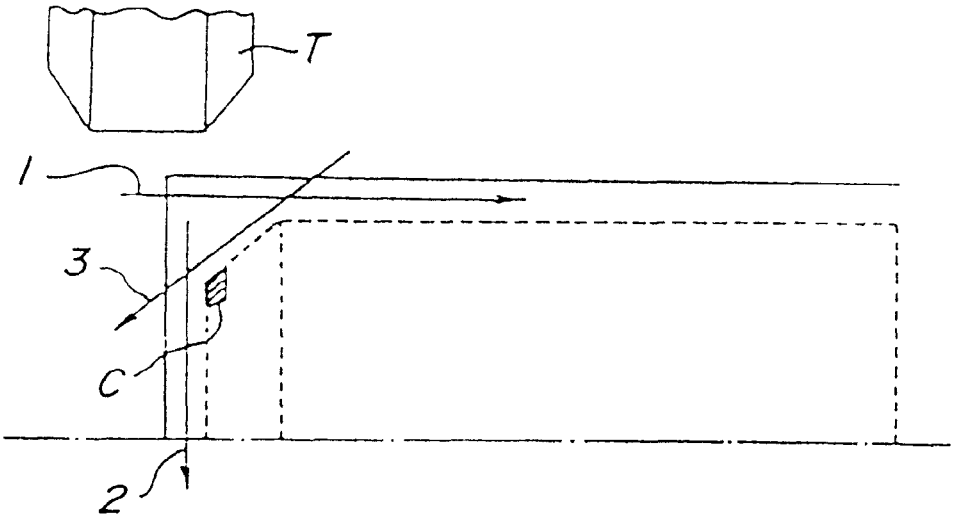
FIG 4 PRIOR ART
FIG. 4 shows the order and directions for machining a rear end portion of a shaft of the valve preform according to a conventional machining process.
Figure 5:
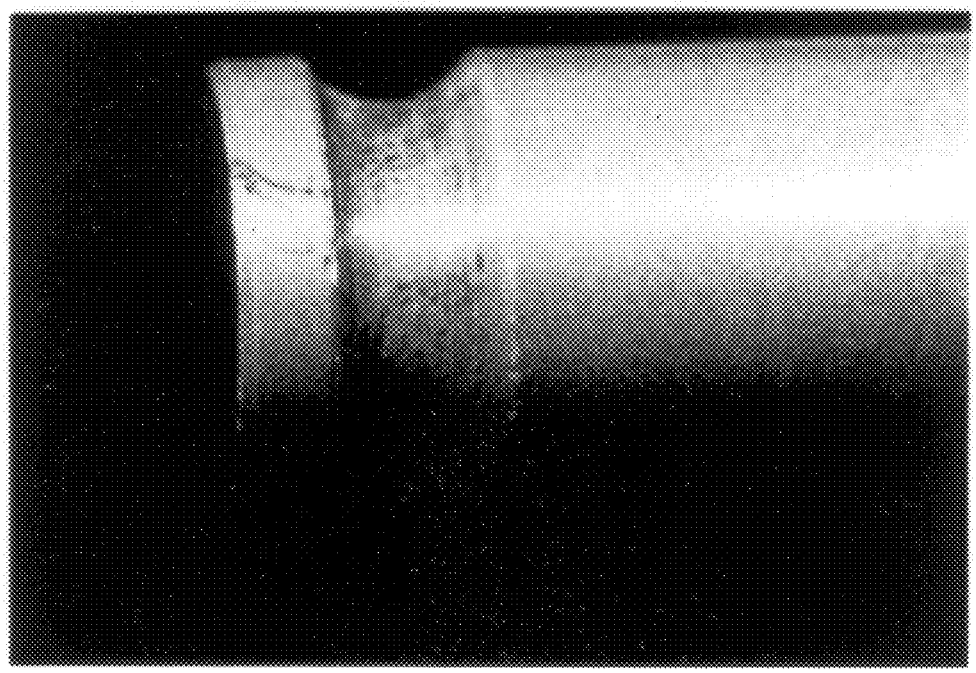
FIG. 5 PRIOR ART
FIG. 5 is an enlarged photograph for showing chipping occurred at an end portion of the shaft of the valve preform ground in the first station according to the conventional machining process.
Figure 6:
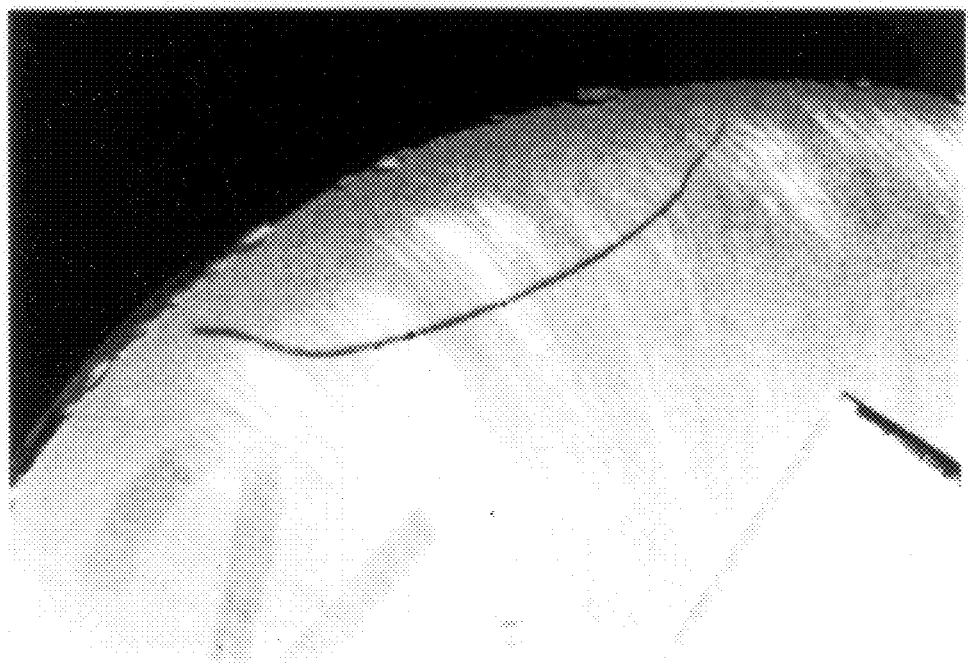
FIG. 6 PRIOR ART
FIG. 6 is an enlarged photograph for showing chipping occurred at the head portion the valve preform ground in the first station according to the conventional machining process.
Figure 7:
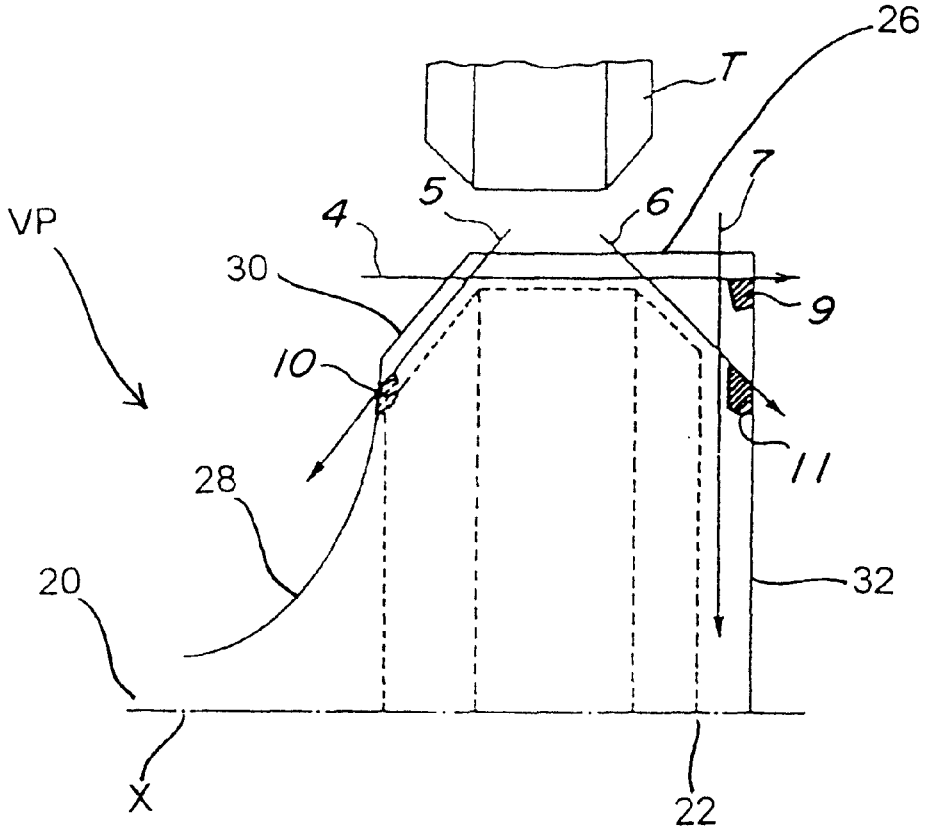
FIG. 7 shows an example of process for grinding a valve head portion of the engine valve preform made of a ceramic material as a ceramic article without chipping according to the present invention.
Figure 8:
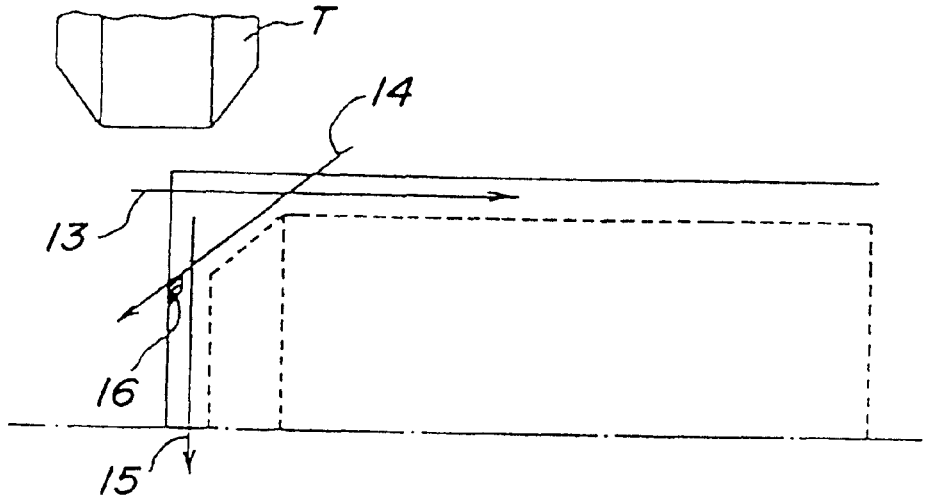
FIG. 8 shows the process for grinding a rear edge portion of a shaft portion of the engine valve preform made of a ceramic material as a ceramic article without chipping according to the present invention.
Figure 9:
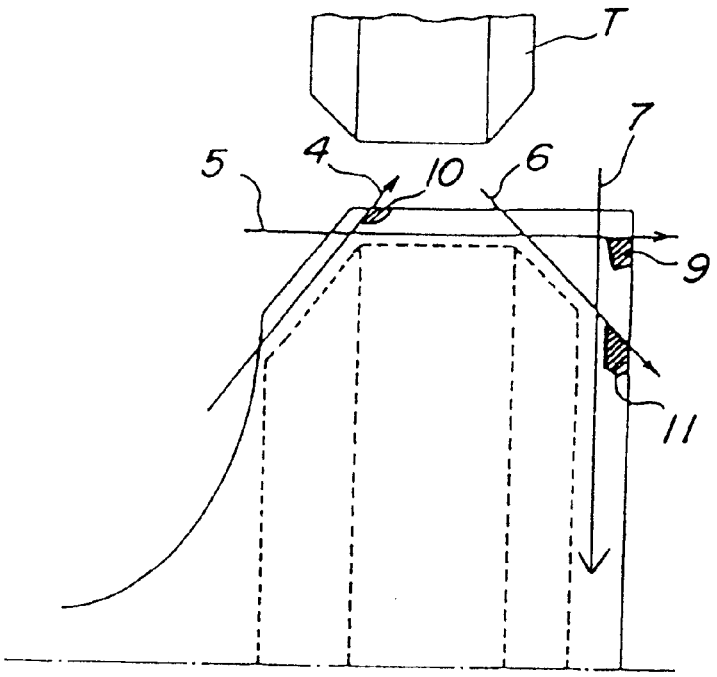
FIGS. 9 and 10 show another example of the process for grinding a valve head portion and a rear edge portion of a shaft portion of an engine valve preform made of a ceramic material as a ceramic article, without chipping, according to the present invention, respectively.
Figure 10:
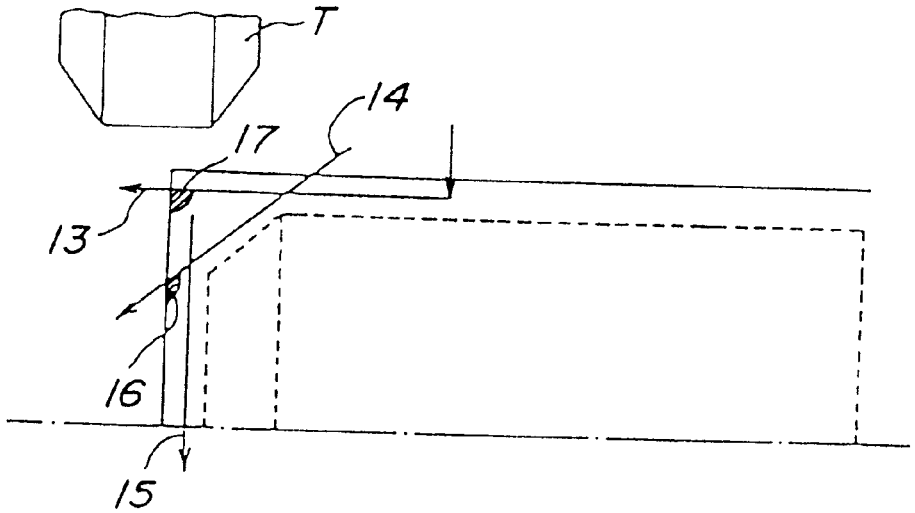
Figure 11:
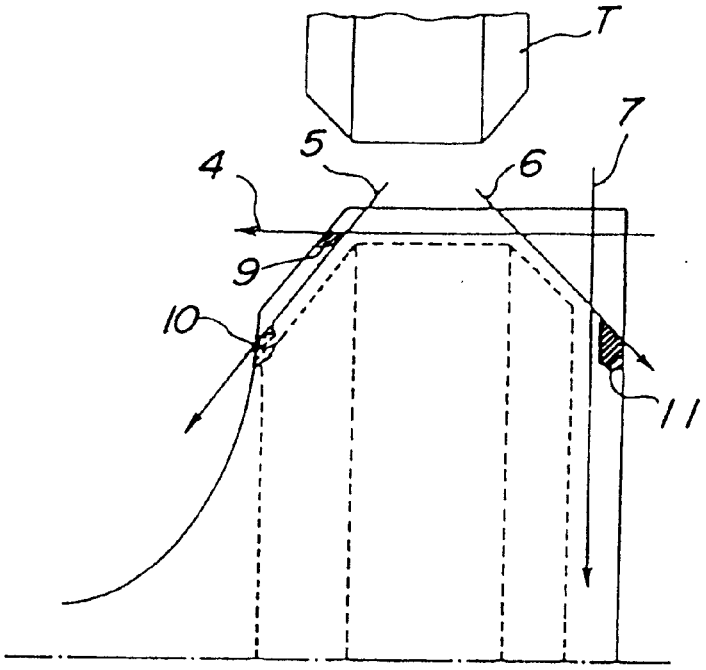
FIGS. 11 and 12 show still another example of the process for grinding a valve head portion and a rear edge portion of a shaft portion of an engine valve preform made of a ceramic material as a ceramic article, without chipping, according to the present invention, respectively.
Figure 12:
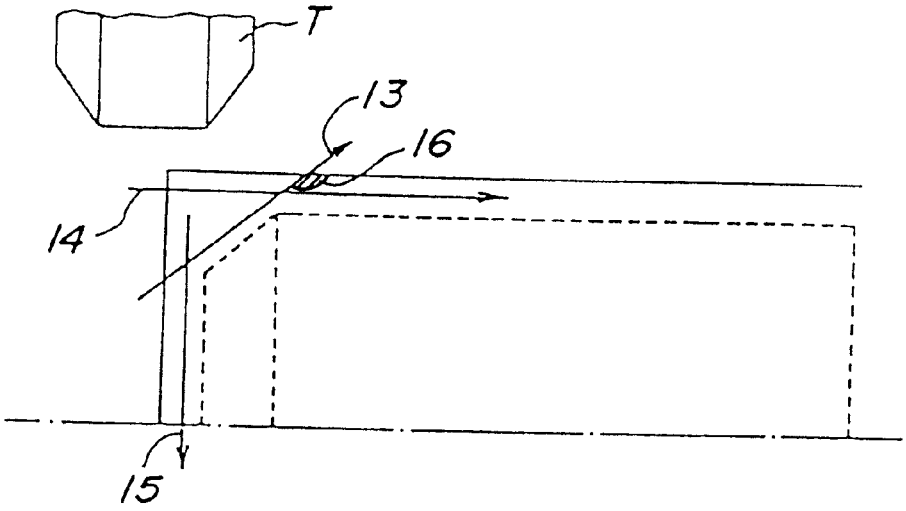
Figure 13:
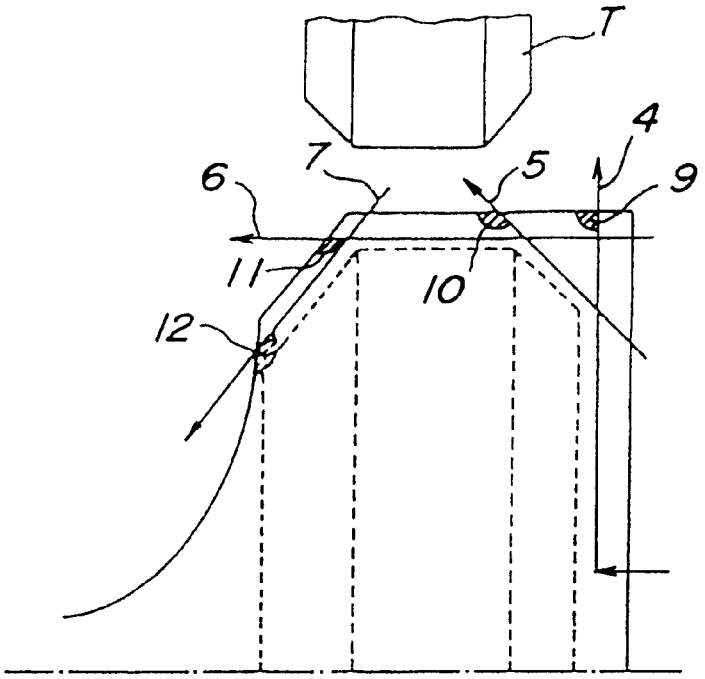
FIGS. 13 and 14 show a further example of the process for grinding a valve head portion and a rear edge portion of a shaft portion of an engine valve preform made of a ceramic material as a ceramic article, without chipping, according to the present invention, respectively.
Figure 14:
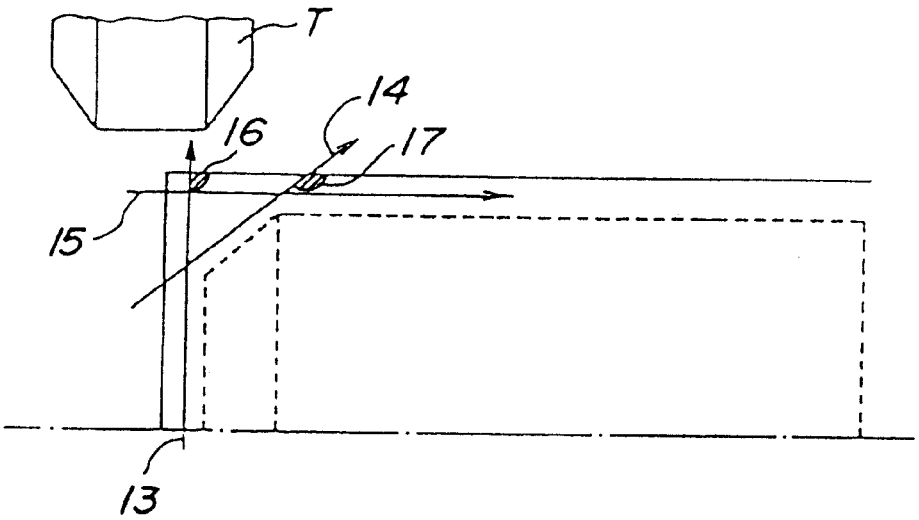
Figure 15:
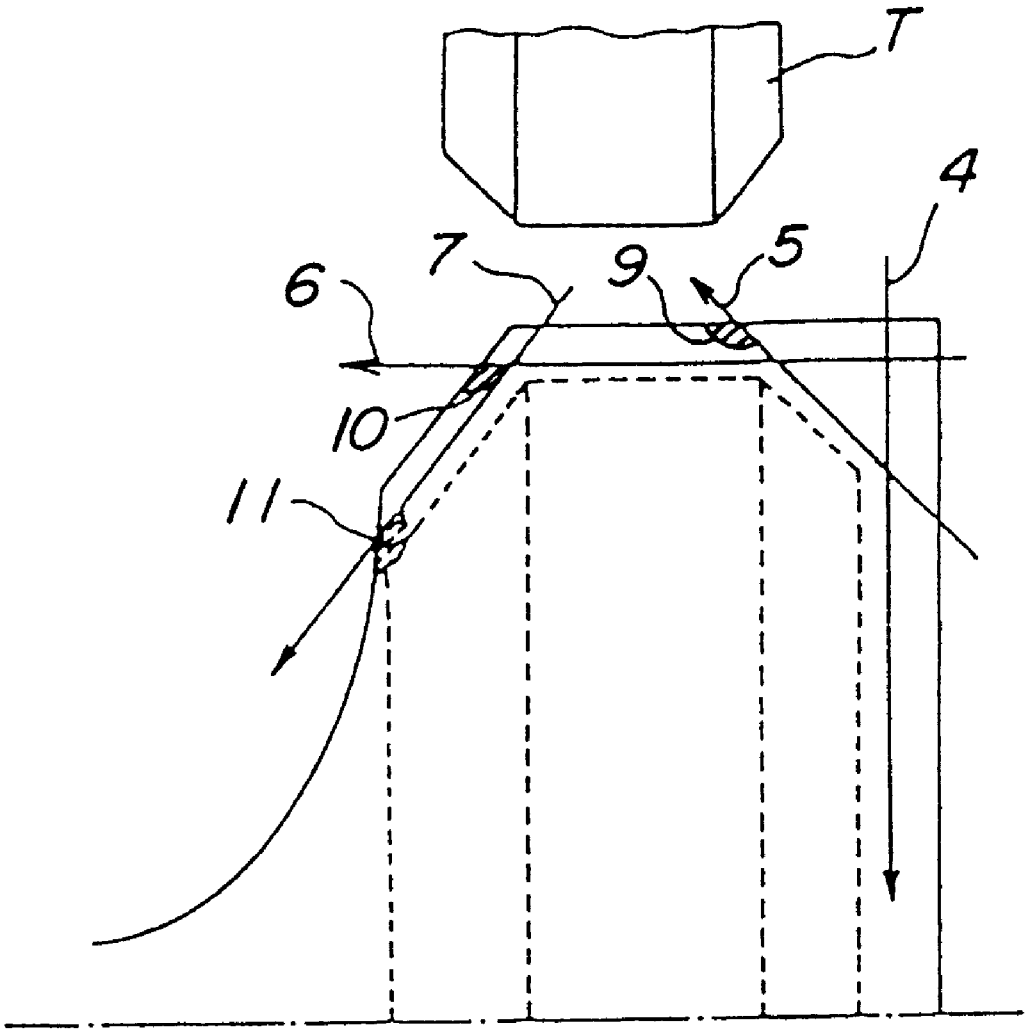
FIG. 15 shows a still further example of the process for grinding a valve head portion of an engine valve preform made of a ceramic material as a ceramic article, without chipping, according to the present invention, respectively.

FIGS. 7 and 8 show the process for machining the engine valve preform VP made of a ceramic material as a ceramic article without chipping according to the present invention. This machining process is fundamentally the same as in the case of the conventional machining process explained in FIGS. 1 to 4 except for the machining order and the machining directions. First, the ceramic engine valve preform is chucked at the shaft portion 20 (See FIG. 2), the valve head portion 22 and the rear end portion 24 of the shaft are ground by the grinding tool T (See FIGS. 7 and 8). As to the valve head portion 22, it is ground by means of the grinding tool T in the machining order and directions as shown by "4", "5", "6" and "7", while the valve preform is being rotated around its axis. That is, the grinding stone T is first moved from left to right as shown by "4", thereby grinding the peripheral face 26 of the valve head portion.

Chipping occurs at an edge portion 9 through which the grinding stone leaves the valve head portion 22. Next, a valve seat surface at which the valve head seats a valve seat is formed through grinding by moving the grinding tool downwardly from right to left as shown by "5". It may be considered that chipping occurs at a portion 10 by the above grinding. However, since the portion 9 through which the grinding stone leaves the valve head portion 22 has a shape concaved (28) toward the axis, chipping is unlikely to occur. Even if chipping occurs, it is very limited. Therefore, such a very limited chipped portion can be easily removed by ordinary finishing performed next in the station 2. Then, in the station 1, a chamfered or inclined face 30 is formed as a chucking face by moving the grinding stone downwardly from left to right as shown by "6". At that time, the chipping at the portion 9 is removed by the grinding in the step "4", whereas chipping occurs in a right lower edge portion 11 through which the grinding stone leaves the head portion. Finally, as shown by "7", the end face 32 of the valve head portion is ground. As shown in FIG. 7, the end face 32 extends substantially perpendicularly to the central longitudinal axis X thereof. Since the valve preform is rotated, the end face 32 of the valve head portion needs not be machined by moving the grinding tool through the entire end face, different from the machining in the case of "4", "5" and "6", but ordinarily up to a portion slightly beyond the center of the end face 32 of the valve head has only to be ground in a contacted manner. By so doing, the chipping occurred at "9" by the grinding in "4" is removed, whereas no chipping occurs in the grinding of the end face 32 in "7" because the end face 32 is ground not through the entire face from one side to the other in "7". Similarly, as to the end portion of the valve shaft, the peripheral or concave face 28 of the shaft end portion 24 is ground by moving the grinding stone T under rotation of the valve preform over a given length as shown by "13" (In this case, no chipping occurs). Then, after a corner of the shaft edge portion is chamfered as shown by "14", and a chucking face is formed in the station 1 (In this case, chipping occurs in a portion 16 of the end face of the shaft portion through which the grinding stone leaves it). Finally, the chipped portion formed at 16 in the grinding of "14" is removed by grinding the end face in "15". No chipping occurs in the case of the grinding of the end face in "15". In this manner, the ceramic view fundamentally free from chipping can be obtained by the rough grinding. This ceramic valve is finish ground by an ordinary method in the station 2, thereby obtaining a finish ground ceramic valve (See shapes shown by dotted lines in FIGS. 7 and 8).

In FIGS. 7 and 8, so long as the effects aimed at by the chipping-free machining process according to the present invention, the machining order and/or the machining directions may be appropriately changed, for example, the grinding in "4" of FIG. 7 may be effected from right to left.

Other examples of the process for grinding a valve head portion 22 and a rear edge portion of a shaft portion of an engine valve preform made of a ceramic material as a ceramic article, without chipping, according to the present invention are shown in FIGS. 9 through 15. The engine valve preforms are machined in the same manner as in FIGS. 7 and 8 (chucking, grinding, grinding tool, grinding stone and machining under rotation) except for the machining order and the machining directions are indicated in the same manner as in FIGS. 7 and 8. As to the grinding process in FIG. 15, a rear edge portion of a shaft portion of the engine valve preform is machined according to the any one of the methods in FIGS. 8, 10, 12 and 14. As easily understood, the examples of the grinding process shown in FIGS. 9 through 15 fall in the scope of the claimed invention.

The process for machining the edge portion of the ceramic article without chipping according to the present invention has the following effects.

(1) The consecutive machining steps and machining directions are selected such that a chipped portion occurring in a machined part of said edge portion in a certain machining step is removed by any succeeding step, and a lastly remaining part of the edge portion of ceramic article is machined in a final step without chipping, thereby enabling the edge portions of the ceramic article to be ground without chipping. Therefore, any chipped portion needs not be removed in the post machining treatment. Thus, the ceramic article can be effectively machined. Further, since any chipped portion needs not be removed in the post machining treatment, the ceramic article finished at a necessary minimum level, thereby enhancing the yield of the products.

(2) When the above edge portion of the ceramic article is included in any of an end face 32, a peripheral face 26 continuing to the end face 32, an inclined face 30 continuing to the peripheral face 26, and a concaved face 28 continuing to the inclined face 30, and the consecutive machining steps and the machining directions are selected such that a side of a machined part of the ceramic article through which a grinding tool left in a certain machining step is set at a side of a part of the ceramic article through which the grinding tool enters in any succeeding step, the same effects mentioned in (1) may be obtained.

(3) When the ceramic article preform is a valve preform having a rotationary symmetrical shape, made of a ceramic material and comprising a head portion and a shaft portion, and said machining is to grind edge portions of the head portion and the shaft portion of the valve preform while the valve preform is being rotated around an axis of the valve preform. Such a ceramic valve preform free from chipping can be easily produced without necessitating excess amount of the finishing. Further, in this case, when the machining of said lastly remaining part of the edge portion of ceramic article preform in said final step without chipping is to machine an end face of the ceramic valve preform, said end face extending in a direction substantially perpendicular to the axis in said rotation or being convexed in an axially outward direction, no chipping occurs in the final machining step. Therefore, the ground ceramic valve free from chipping can be obtained, which can be easily finished in the post machining.

What is claimed is:

1. A process for machining an edge portion of a ceramic article preform, comprising the steps of:

a) providing a ceramic article preform;

b) machining the ceramic article preform to provide an edge portion, wherein the edge portion includes a chipped portion;

c) then machining the ceramic article preform in one or more preselected directions, thereby forming one or more faces and one or more edges thereon, and thereby removing said chipped portion; and d) then finally machining a face of the ceramic article without chipping an edge thereof.

2. The machining process of claim 1, wherein the steps b) and c) comprise producing one or more of an end face, a peripheral face, an inclined face and a concave face on the ceramic article by machining in preselected directions.

3. The machining process of claim 2, wherein the edge portion being machined is included in one or more of the end face, the peripheral face, the inclined face and the concave face.

4. The machining process of claim 1, wherein: the machining step b) comprises moving a grinding tool from one side of the ceramic article preform to the other side thereof; and the chipped portion removal step c) comprises moving the grinding tool in a direction approaching the ceramic article preform from adjacent the left side to the right side thereof for removing the chipped portion.

5. The machining process of claim 1, wherein the ceramic article preform comprises a valve preform.

6. The machining process of claim 1, wherein the ceramic article preform comprises a radially symmetrical preform.

7. The machining process of claim 5, wherein the ceramic article preform comprises a head portion and a shaft portion.

8. The machining process of claim 7, wherein machining of the valve preform is carried out by grinding the head and shaft portions substantially simultaneously while rotating the valve preform.

9. The machining process of claim 8, wherein machining of the valve preform comprises grinding the edge portions of the head portion.

10. The machining process of claim 1, wherein the ceramic article preform comprises an end face extending substantially perpendicularly to a central longitudinal axis thereof.

11. The machining process of claim 10, wherein the end face is substantially planar.

12. The machining process of claim 10, wherein the end face is convex in an axially outward direction.

13. The machining process of claim 10, wherein step d) comprises machining the end face.

14. The machining process of claim 1, wherein the steps b) and c) comprise machining the ceramic article preform in consecutive independent steps to produce a peripheral face, a left inclined face, a right inclined face and an end face by machining in corresponding preselected directions.

* * * * *